US006044524A

United States Patent [19]

Sorensen et al.

[11] Patent Number: 6,044,524

[45] Date of Patent: Apr. 4, 2000

[54] REMOVAL OF INJECTION-MOLDED CABLE TIE FROM MOLD

[75] Inventors: Soren Christian Sorensen; Jens Ole Sorensen, both of Grand Cayman, Cayman Islands

[73] Assignee: GB Electrical, Inc., Milwaukee, Wis.

[21] Appl. No.: 09/238,128

[22] Filed: Jan. 27, 1999

[51] Int. Cl.[7] ..... B65D 63/00

[52] U.S. Cl. ..... 24/16 PB; 24/17 AP; 24/30.5 P

[58] Field of Search ..... 24/16 PB, 17 AP, 24/30.5 P

[56] References Cited

U.S. PATENT DOCUMENTS

| | | | |
|---|---|---|---|
| 3,924,299 | 12/1975 | McCormick . | |
| 4,473,524 | 9/1984 | Paradis | 24/16 PB |
| 5,146,654 | 9/1992 | Caveney et al. | 24/17 AP |
| 5,389,330 | 2/1995 | Sorensen et al. | 24/16 PB |
| 5,440,786 | 8/1995 | Sorensen et al. | 24/16 PB |
| 5,664,294 | 9/1997 | Sorensen et al. | 24/16 PB |
| 5,716,579 | 2/1998 | Sorensen et al. | 24/16 PB |

FOREIGN PATENT DOCUMENTS

| | | | |
|---|---|---|---|
| 0968131 | 5/1975 | Canada | 24/16 PB |
| 1519233 | 7/1978 | United Kingdom | 24/16 PB |

*Primary Examiner*—Victor N. Sakran
*Attorney, Agent, or Firm*—Edward W. Callan

[57] ABSTRACT

A tie including a tongue and a locking head having a pawl that is hinged at one side of an opening in the locking head across the opening from an abutment surface for locking engagement with a first set of ratchet teeth on one side of the tongue when the tongue has been inserted through the opening, and also having teeth on the abutment surface for locking engagement with a second set of ratchet teeth on the other side of the tongue when the tongue has been so inserted, is formed by injection molding. An artifact line is formed at a parting line between the mold parts while the plastic material solidifies in the mold cavity. Removal of the injection-molded tie from the mold parts without significant damage to the abutment surface teeth as the mold parts are being separated in a direction normal to the parting line is facilitated by the direction of insertion being at an obtuse angle to an extension of the artifact line from the abutment surface toward the pawl, by the facing surface of each abutment surface tooth extending in a direction away from the artifact line at a non-acute angle with respect to the extension of the artifact line from the abutment surface toward the pawl, and by an extension of the locking surface of each abutment surface tooth from the abutment surface being at an acute angle with respect to the extension of the artifact line from the abutment surface toward the pawl.

11 Claims, 1 Drawing Sheet

REMOVAL OF INJECTION-MOLDED CABLE TIE FROM MOLD

BACKGROUND OF THE INVENTION

The present invention generally pertains an injection-molded tie that is useful for forming a loop for retaining a bundle of elongated articles, such as cables, and is particularly directed to removal of the tie from the mold. Such a tie is commonly known as a cable tie.

One type of tie includes an elongated tongue with two ends and two broad sides, a locking head at one end of the tongue, a first set of ratchet teeth extending along one broad side of the tongue and a second set of ratchet teeth extending along the other broad side of the tongue, wherein the locking head has sides defining an opening for receiving the tongue, the sides include a movable pawl that is hinged at one side of said opening and an abutment surface that is across the opening from the pawl, and the pawl has at least one pawl tooth disposed for engaging the set of first ratchet teeth when the tongue has been inserted through said opening with the first set of ratchet teeth facing the pawl, wherein the pawl, when the at least one pawl tooth is so engaged, is movable toward the abutment surface in response to pressure applied to the tongue in a direction opposite to the direction of said insertion in order to force the second set of ratchet teeth against the abutment surface; and wherein the abutment surface includes at least one tooth, each having a facing surface extending toward an apex and a locking surface extending toward the apex, for locking engagement with the second set of ratchet teeth when the tongue has been inserted through the opening with the second set of ratchet teeth facing the abutment surface and the side of the tongue including the second set of ratchet teeth is forced against the abutment surface by movement of the pawl. This particular design of a tie is preferred because the combined engagement of ratchet teeth on both sides of the tongue enhances the retaining function of the tie. Such a tie is described in U.S. Pat. No. 4,473,524 to Paradis and U.S. Pat. No. 5,146,654 to Caveney et al.

A method of injection molding such a tie includes the steps of:

(a) providing a mold that includes mold parts joined at a parting line for defining a cavity between the mold parts in the general shape of the tie;

(b) injecting molten plastic material into the mold cavity;

(c) solidifying the plastic material in the mold cavity to form the tie;

(d) separating the mold parts in a direction normal to the parting line to enable ejection of the tie from mold; and (e) ejecting the solidified tie from the mold.

It would appear that unless (a) there is only one tooth on the abutment surface of the tie, and (b) the mold parts are separated at the portion of the mold cavity that defines the apex of the abutment surface tooth, the abutment surface tooth would be significantly damaged upon separation of the mold parts.

SUMMARY OF THE INVENTION

The present invention provides a injection-molded tie that can be removed from the mold without significant damage to the at least one abutment surface tooth and further provides a method for injection molding such a tie.

A tie according to the present invention comprises: an elongated tongue with two ends and two broad sides; a locking head at one end of the tongue; a first set of ratchet teeth extending along one broad side of the tongue; and a second set of ratchet teeth extending along the other broad side of the tongue; wherein the locking head has sides defining an opening for receiving the tongue, the sides include a movable pawl that is hinged at one side of said opening and an abutment surface that is across the opening from the pawl, and the pawl has at least one pawl tooth disposed for engaging the set of first ratchet teeth when the tongue has been inserted through said opening with the first set of ratchet teeth facing the pawl; wherein the pawl, when the at least one pawl tooth is so engaged, is movable toward the abutment surface in response to pressure applied to the tongue in a direction opposite to the direction of said insertion in order to force the second set of ratchet teeth against the abutment surface; wherein the abutment surface includes at least one tooth, each having a facing surface and a locking surface for locking engagement with the second set of ratchet teeth when the tongue has been inserted through the opening with the second set of ratchet teeth facing the abutment surface and the side of the tongue including the second set of ratchet teeth is forced against the abutment surface by movement of the pawl; wherein the tie has an artifact line formed at a parting line at which mold parts are joined during injection molding of the tie to define a cavity for forming the tie; and wherein the direction of said insertion is at an obtuse angle to an extension of the artifact line from the abutment surface toward the pawl.

A method according to the present invention of injection molding a tie that includes an elongated tongue with two ends and two broad sides, a locking head at one end of the tongue, a first set of ratchet teeth extending along one broad side of the tongue and a second set of ratchet teeth extending along the other broad side of the tongue, wherein the locking head has sides defining an opening for receiving the tongue, the sides include a movable pawl that is hinged at one side of said opening and an abutment surface that is across the opening from the pawl, and the pawl has at least one pawl tooth disposed for engaging the set of first ratchet teeth when the tongue has been inserted through said opening with the first set of ratchet teeth facing the pawl, wherein the pawl, when the at least one pawl tooth is so engaged, is movable toward the abutment surface in response to pressure applied to the tongue in a direction opposite to the direction of said insertion in order to force the second set of ratchet teeth against the abutment surface; and wherein the abutment surface includes at least one tooth, each having a facing surface and a locking surface for locking engagement with the second set of ratchet teeth when the tongue has been inserted through the opening with the second set of ratchet teeth facing the abutment surface and the side of the tongue including the second set of ratchet teeth is forced against the abutment surface by movement of the pawl; comprises the steps of:

(a) providing a mold that includes mold parts joined at a parting line for defining a cavity between the mold parts in the general shape of the tie;

(b) injecting molten plastic material into the mold cavity;

(c) solidifying the plastic material in the mold cavity to form the tie, with the tie having an artifact line formed at the parting line while the plastic material solidifies in the mold cavity; and (d) separating the mold parts in a direction normal to the parting line to enable ejection of the tie from mold; and (e) ejecting the solidified tie from the mold;

wherein step (a) comprises providing a said mold which defines a tie in which the direction of said insertion is at an obtuse angle to an extension of the artifact line from the abutment surface toward the pawl.

Additional features of the present invention are described with reference to the detailed description of the preferred embodiments.

DETAILED DESCRIPTION

Figure 1:
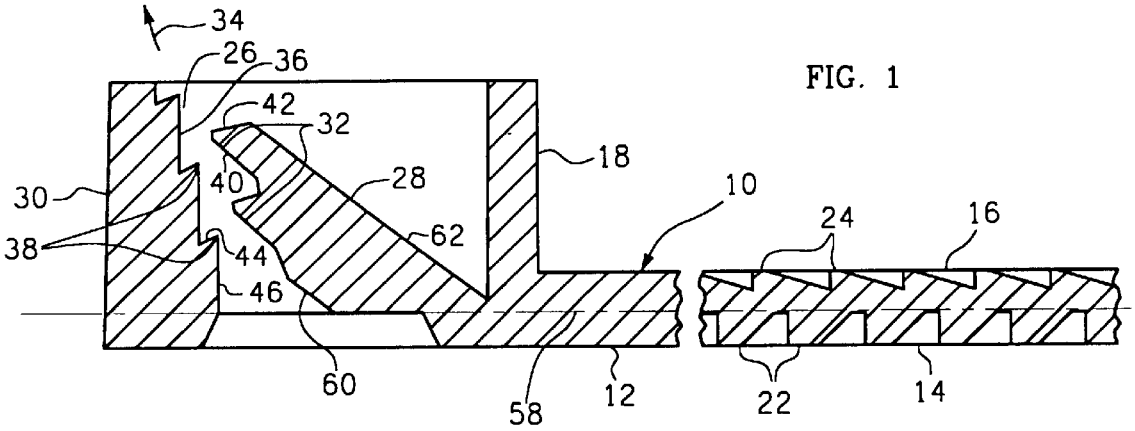
FIG. 1 is a fragmentary sectional view of a preferred embodiment of a tie according to the present invention.
Figure 2:
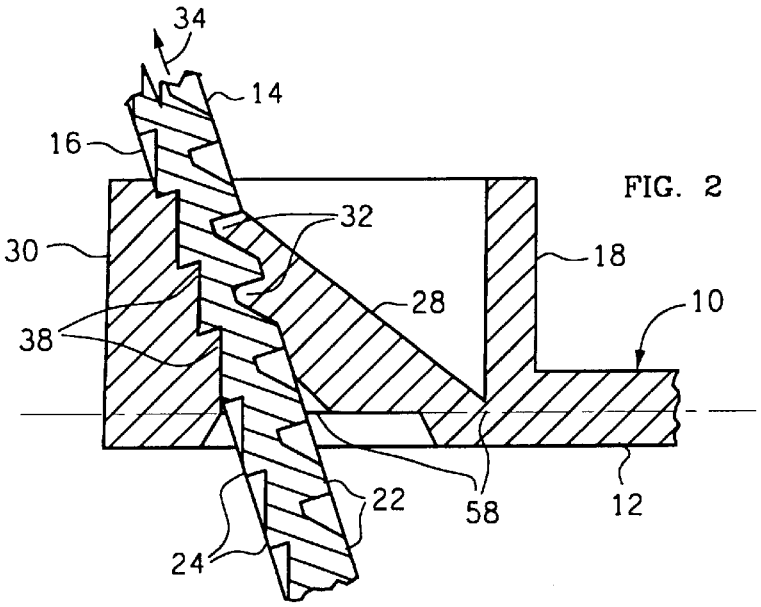
FIG. 2 is a fragmentary sectional view illustrating the engagement of the ratchet teeth on the tongue with the abutment surface teeth and the pawl teeth within the locking head of the tie shown in FIG. 1.

Referring to FIGS. 1 and 2, a preferred embodiment of the tie 10 of the present invention includes an elongated tongue 12 with two ends and two broad sides 14, 16, a locking head 18 at one end of the tongue, a tip at the other end of the tongue 12, a first set of ratchet teeth 22 extending along one broad side 14 of the tongue 12 and a second set of ratchet teeth 24 extending along the other broad side 16 of the tongue 12. The locking head 18 has sides defining an opening 26 for receiving the tip 20 of the tongue 12. The sides include a movable pawl 28 that is hinged at one side of the opening 26 and an abutment wall 30 that is across the opening 26 from the pawl 28. The pawl 28 has a plurality of pawl teeth 32 disposed for locking engagement with the first set of ratchet teeth 22 when the tip of the tongue 12 has been inserted through the opening 26 with the first set of ratchet teeth 22 facing the pawl 28. When at least one pawl tooth 32 is so engaged, the pawl 28 is movable toward the abutment wall 30 in response to a pulling force applied to the tongue 12 in a direction opposite to the direction of insertion 34 in order to force the tongue 12 against an abutment surface 36 of the abutment wall 30. A plurality of teeth 38 are disposed on the abutment surface 36 for engaging the second set of ratchet teeth 24 when the tip 20 of the tongue 12 has been inserted through the opening 26 with the second set of ratchet teeth 24 facing the abutment surface 36 and the side 16 of the tongue 12 including the second set of ratchet teeth 24 is forced against the abutment surface 36 by movement of the pawl 28 in response to a pulling force applied to the tongue 12 in a direction opposite to the direction of insertion 34.

Each of the pawl teeth 32 has a facing surface 40 and a locking surface 42 for locking engagement with complementary surfaces of a tooth of the first set of ratchet teeth 22 on the one side 14 of the tongue 12 when the tongue 12 has been inserted through the opening 26 with the first set of ratchet teeth 22 facing the pawl 28.

Each of the abutment surface teeth 38 has a facing surface 46 and a locking surface 44 for locking engagement with complementary surfaces of a tooth of the second set of ratchet teeth 24 on the other side 16 of the tongue 12 when the tongue 12 such that each facing surface 46 of the abutment surface teeth 38 abuts a majority of the portion of the tongue 12 that is adjacent such facing surface 46 has been inserted through the opening 26 with the second set of ratchet teeth 24 facing the abutment surface 36 and the side 16 of the tongue 12 including the second set of ratchet teeth 24 is forced against the abutment surface 36 by movement of the pawl 28.

Figure 3:
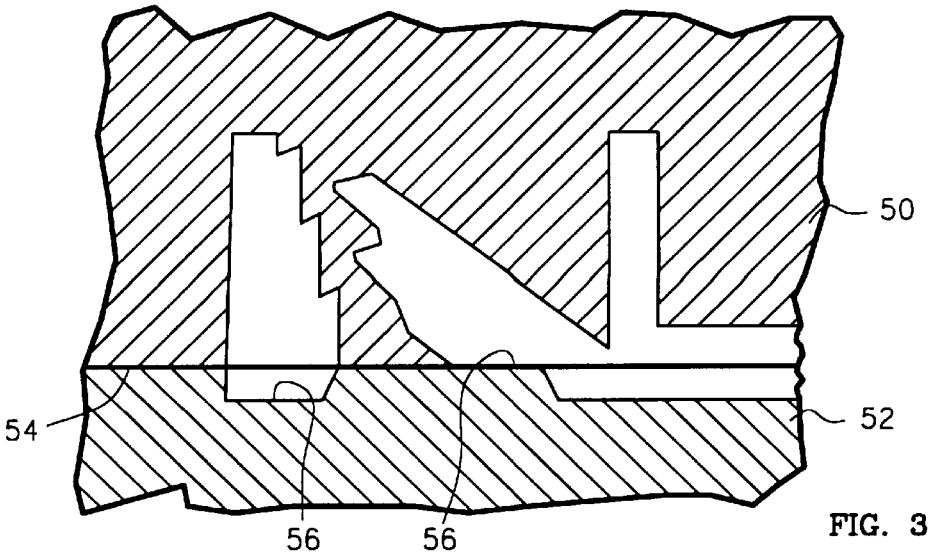
FIG. 3 is a fragmentary sectional view illustrating portions of the mold parts that define the abutment surface and the pawl within the locking head of the tie shown in FIG. 1.

Ties 10 according to the present invention are made by injection molding. With respect to an individual tie 10, the mold includes mold parts 50, 52 that are joined at a parting line 54 to define a cavity 56 between the mold parts 50, 52 in the general shape of the tie 10, as shown in pertinent part in FIG. 3. Molten plastic material is injected into the mold cavity 56 and cools therein to solidify the plastic material to form the tie 10. The tie has an artifact line 58 formed at the parting line 54 while the plastic material solidifies in the mold cavity 56. The mold parts 50, 52 are separated in a direction normal to the parting line 54 to enable ejection of the tie 10 from the mold; and the solidified tie 10 is ejected from the mold.

In order to facilitate removal of the injection-molded tie 10 from the mold parts 50, 52 without significant damage to the abutment surface teeth 38, the tie 10 is so shaped by the mold parts 50, 52 that the direction of insertion 34 is at an obtuse angle to an extension of the artifact line 58 from the abutment surface 36 toward the pawl 28.

In order to further facilitate removal of the injection-molded tie 10 from the mold parts 50, 52 without significant damage to the abutment surface teeth 38, the facing surface 46 of each abutment surface tooth 38 extends in a direction away from the artifact line 58 at a non-acute angle with respect to the extension of the artifact line 58 from the abutment surface 36 toward the pawl 28 and an extension of the locking surface 44 of each abutment surface tooth 38 from the abutment surface 36 is at an acute angle with respect to the extension of the artifact line 58 from the abutment surface 36 toward the pawl 28.

As the tie 10 is being ejected from the top mold part 50, either during separation of the mold parts 50, 52 or thereafter, the pawl 28 pivots upward and away from the abutment wall 30 to thereby enable the tie 10 to be removed from the mold parts 50, 52 without significant damage to the pawl teeth 32.

In order to further enable removal of the injection-molded tie 10 from the mold parts 50, 52 without significant damage to the pawl teeth 32, the side 60 of the pawl 28 that includes the teeth 32 does not diverge from the opposite side 62 of the pawl 28 in the direction of insertion 34. In the preferred embodiment illustrated herein, the side 59 of the pawl 28 that includes the teeth 32 and the facing surfaces 42 of the pawl teeth 32 are parallel with the opposite side 60 of the pawl 28. In an alternative preferred embodiment (not shown), the side 59 of the pawl 28 that includes the teeth 32 and the facing surfaces 42 of the pawl teeth 32 converge toward the opposite side 60 of the pawl 28 in the direction of insertion 34.

The advantages specifically stated herein do not necessarily apply to every conceivable embodiment of the present invention. Further, such stated advantages of the present invention are only examples and should not be construed as the only advantages of the present invention.

While the above description contains many specificities, these should not be construed as limitations on the scope of the present invention, but rather as examples of the preferred embodiments described herein. Other variations are possible and the scope of the present invention should be determined not by the embodiments described herein but rather by the claims and their legal equivalents.

We claim:

1. A tie comprising an elongated tongue with two ends and two broad sides;

a locking head at one end of the tongue;

a first set of ratchet teeth extending along one broad side of the tongue; and a second set of ratchet teeth extending along the other broad side of the tongue;

wherein the locking head has sides defining an opening for receiving the tongue, the sides include a movable pawl that is hinged at one side of said opening and an abutment surface that is across the opening from the pawl, and the pawl has at least one pawl tooth disposed for engaging the set of first ratchet teeth when the tongue has been inserted through said opening with the first set of ratchet teeth facing the pawl;

wherein the pawl, when the at least one pawl tooth is so engaged, is movable toward the abutment surface in response to pressure applied to the tongue in a direction opposite to the direction of said insertion in order to force the second set of ratchet teeth against the abutment surface;

wherein the abutment surface includes at least one tooth, each having a facing surface and a locking surface for locking engagement with the second set of ratchet teeth when the tongue has been inserted through the opening with the second set of ratchet teeth facing the abutment surface and the side of the tongue including the second set of ratchet teeth is forced against the abutment surface by movement of the pawl;

wherein the tie has an artifact line formed at a parting line at which mold parts are joined during injection molding of the tie to define a cavity for forming the tie; and wherein the direction of said insertion is at an obtuse angle to an extension of the artifact line from the abutment surface toward the pawl.

2. A tie according to claim 1, wherein the facing surface extends in a direction away from the artifact line at a non-acute angle with respect to the extension of the artifact line from the abutment surface toward the pawl.

3. A tie according to claim 2, wherein an extension of the locking surface from the abutment surface is at an acute angle with respect to the extension of the artifact line from the abutment surface toward the pawl.

4. A tie according to claim 1, wherein an extension of the locking surface from the abutment surface is at an acute angle with respect to the extension of the artifact line from the abutment surface toward the pawl.

5. A tie according to claim 1, comprising a plurality of said abutment surface teeth.

6. A tie according to claim 1, wherein each facing surface of the at least one tooth on the abutment surface teeth abuts a majority of the portion of the tongue that is adjacent said facing surface when the second set of ratchet teeth is forced against the abutment surface by movement of the pawl.

7. A method of injection molding a tie that includes an elongated tongue with two ends and two broad sides, a locking head at one end of the tongue, a first set of ratchet teeth extending along one broad side of the tongue and a second set of ratchet teeth extending along the other broad side of the tongue, wherein the locking head has sides defining an opening for receiving the tongue, the sides include a movable pawl that is hinged at one side of said opening and an abutment surface that is across the opening from the pawl, and the pawl has at least one pawl tooth disposed for engaging the set of first ratchet teeth when the tongue has been inserted through said opening with the first set of ratchet teeth facing the pawl, wherein the pawl, when the at least one pawl tooth is so engaged, is movable toward the abutment surface in response to pressure applied to the tongue in a direction opposite to the direction of said insertion in order to force the second set of ratchet teeth against the abutment surface; and wherein the abutment surface includes at least one tooth, each having a facing surface and a locking surface for locking engagement with the second set of ratchet teeth when the tongue has been inserted through the opening with the second set of ratchet teeth facing the abutment surface and the side of the tongue including the second set of ratchet teeth is forced against the abutment surface by movement of the pawl; the method comprising the steps of:

(a) providing a mold that includes mold parts joined at a parting line for defining a cavity between the mold parts in the general shape of the tie;

(b) injecting molten plastic material into the mold cavity;

(c) solidifying the plastic material in the mold cavity to form the tie, with the tie having an artifact line formed at the parting line while the plastic material solidifies in the mold cavity; and (d) separating the mold parts in a direction normal to the parting line to enable ejection of the tie from mold; and (e) ejecting the solidified tie from the mold;

wherein step (a) comprises providing a said mold which defines a tie in which the direction of said insertion is at an obtuse angle to an extension of the artifact line from the abutment surface toward the pawl.

8. A method according to claim 7, wherein step (a) further comprises providing a said mold which defines a tie in which the facing surface extends in a direction away from the artifact line at a non-acute angle with respect to the extension of the artifact line from the abutment surface toward the pawl.

9. A method according to claim 8, wherein step (a) further comprises providing a said mold which defines a tie in which an extension of the locking surface from the abutment surface is at an acute angle with respect to the extension of the artifact line from the abutment surface toward the pawl.

10. A method according to claim 7, wherein step (a) further comprises providing a said mold which defines a tie in which an extension of the locking surface from the abutment surface is at an acute angle with respect to the extension of the artifact line from the abutment surface toward the pawl.

11. A method according to claim 7, wherein step (a) further comprises providing a said mold which defines a tie in which each facing surface of the at least one tooth on the abutment surface teeth abuts a majority of the portion of the tongue that is adjacent said facing surface when the second set of ratchet teeth is forced against the abutment surface by movement of the pawl.

* * * * *